US006889615B2

(12) United States Patent
Johnson et al.

(10) Patent No.: US 6,889,615 B2
(45) Date of Patent: May 10, 2005

(54) POWER DRIVEN CONVEYOR

(75) Inventors: William Johnson, Miramar, FL (US); Paul Bridgewater, Saline, MI (US)

(73) Assignee: Bridgewater Products, Inc., Saline, MI (US)

( * ) Notice: Subject to any disclaimer, the term of this patent is extended or adjusted under 35 U.S.C. 154(b) by 116 days.

(21) Appl. No.: 10/143,384

(22) Filed: May 10, 2002

(65) Prior Publication Data

US 2003/0079641 A1 May 1, 2003

Related U.S. Application Data

(63) Continuation-in-part of application No. 10/036,270, filed on Oct. 27, 2001, now abandoned.

(51) Int. Cl.[7] ..... B61B 13/00
(52) U.S. Cl. ..... 104/162
(58) Field of Search ..... 104/162, 164, 104/88.01, 106, 107, 111, 89; 198/781.02, 781.03, 781.04, 678.1, 343.1, 343.2, 465.1

(56) References Cited

U.S. PATENT DOCUMENTS 3,255,865 A * 6/1966 Sullivan ..... 198/781.03
3,599,968 A * 8/1971 Billett et al. ..... 271/14
4,088,220 A * 5/1978 Jacksch et al. ..... 198/803.2
4,753,339 A * 6/1988 Vogt et al. ..... 198/781.03
5,398,802 A * 3/1995 Clopton ..... 198/465.1
5,450,942 A * 9/1995 Johann et al. ..... 198/465.4
5,456,346 A 10/1995 Schilling et al.
5,620,080 A 4/1997 Kassuba
6,206,178 B1 3/2001 Jacobson
6,431,347 B1 8/2002 Gossner
6,460,685 B1 10/2002 Johansson et al.

* cited by examiner

*Primary Examiner*—Frantz F. Jules
(74) *Attorney, Agent, or Firm*—Reising, Ethington, Barnes, Kisselle, P.C.

(57) ABSTRACT

A power driven conveyor having a drive means and a carrier supported for movement along a path of travel parallel to the path of movement provided by the drive means. The carrier has a contact surface adjacent to the drive means that is movable between a first position wherein the contact surface is disengaged from the drive means and a second position wherein the contact surface is frictionally driven by the drive means so as to cause the carrier to move from a first station to a second station along the path of travel provided by the drive means. An actuator is operatively associated with the carrier for causing the contact surface to move between the first position and the second position.

47 Claims, 7 Drawing Sheets

POWER DRIVEN CONVEYOR

The present invention is a continuation-in-part of U.S. patent application Ser. No. 10/036,270 filed on Oct. 27, 2001, now abandoned.

TECHNICAL FIELD

The present invention relates to conveyors where the load supporting carrier is retarded or stopped with the load at a station without being disconnected from the remainder of a continuously moving conveyor. More specifically, the present invention concerns a conveyor wherein the load supporting carrier achieves superior frictional engagement with the drive means by being compressed against the drive means and is disengaged from the drive means by a collapsing action of the carrier.

BACKGROUND OF THE INVENTION

Some of the prior art includes chain conveyors such as power and free conveyors where the load supporting carrier uses hooks, tabs, or dogs to catch a pusher, hole or depression on the moving chain. Besides having a chain that is noisy, this particular type of conveyor suffers from a requirement for lubrication of the chain for proper maintenance and durability and, in effect, provides a dirty system. To disengage the load-supporting carriers, one needs to pivotally or slidably disengage the hook or tab from the moving chain. The moving chain also includes numerous hooks, or pushers to decrease the wait time for engagement and for carrier motion.

Other forms of conveyors utilized pallets that are driven by friction from the supporting conveyor rollers where disengagement or stopping the load supporting portion is achieved by extending a cam, raising a fixed stop, or extending a tab on the pallet. This form of conveyor is limited to gravity for generating frictional forces and thus is generally less useful for inclined conditions. Furthermore, speed of the pallets will vary in the case where loaded pallets create more friction and thus move faster than empty pallets.

Still other forms of conveyors have sought to optimize frictional engagement on the load supporting means by using opposing belts or opposing wheels to pinch the load supporting means with forces derived by actuators external to the load supporting means. This prior art is limited in its ability to permit independent travel or stoppage of the load-supporting portion. One example would be a contiguous line of driveless pallets driven by the last pallet in line which is pinched by drive rollers or driveless pallets each pinched by drive rollers. Another example is evidenced by parallel drive belts where all of the pallets in a given conveyor section receive the same drive force that adjacent pallets receive, or each pallet must be acted upon by a separate drive means leading to numerous drive sections.

It is believed that none of the conveyors previously proposed permits independent travel or stoppage of adjacent load supporting portions while employing a single drive means which optimize frictional drive forces while avoiding tabs or dogs for positive engagement with the drive means.

SUMMARY OF THE INVENTION

The present invention provides a power driven conveyor that utilizes low wear friction means to move a load supporting carrier which is disengagable from a drive means by collapsing a contact surface of the carrier. In one form of the invention, the body of the carrier is moved as a unit for placing the contact surface in engagement with the drive means. In another form of the invention the contact surface is part of a separate member which is connected to the carrier and moved into engagement with the drive means. In yet another form of the invention, the contact surface has the friction level dictated by a pinch engagement of a roller, which becomes the drive means, and the contact surface of the carrier. The power driven conveyor according to the invention requires no tab, hook or other positive engagement means to move the load-supporting carrier.

Broadly stated, the power driven conveyor made in accordance with one form of the present invention includes an endless continuous movable drive means combined with a fixed track. A carrier, which is adapted to support an article, is supported by the track for movement along a path of travel parallel to the path of movement of the drive means. The carrier has a contact surface located adjacent to the drive means that is movable to a first position wherein the contact surface is disengaged or collapsed from the drive means and causes the carrier to be in a "stopped" or stationary condition. The contact surface is movable to a second position wherein the contact surface is frictionally engaged with the movable drive means so as to cause the carrier to be moved along the path of travel of the belt. An actuator, which can be either manually, mechanically or electrically activated, is connected to the carrier for moving the contact surface between the first position and the second position.

Depending upon the type of carrier utilized, the drive means can be directly or indirectly compressed by the contact surface of the carrier to generate forces that permit the desired friction to move the carrier. The collapsibility of the contact surface of the carrier permits the elimination of compression forces and disengagement from the drive means when stoppage is desired. Returning the contact surface of the carrier to its extended mode resumes compression of and frictional engagement with the drive means and permits the carrier to resume motion.

An object of the present invention is to provide a new and improved power driven conveyor that has a carrier for transporting articles that may be connected at infinite intervals of a movable drive means so as to eliminate wait time such as encountered with a chain pusher, or dog, or depression in a chain.

Another object of the present invention is to provide a new and improved power driven conveyor having a carrier provided with a contact surface that is movable through an actuator for placing the contact surface into frictional engagement or disengagement with a drive means.

A further object is to provide a new and improved power driven conveyor in which expansion and collapse of the contact surface of the carrier is provided by non-contact control.

A further object of the present invention is to provide a new and improved conveyor where the means for disengagement and engagement with a drive means is determined by the position of a contact surface portion of the carrier relative to the drive means so as to render onto each carrier the ability to be stopped at infinite points along the conveyor without stopping the rotation of the drive means.

A still further object of the present invention is to provide a new and improved frictional conveyor that is effective for incline by managing friction through dimensional design.

A still further object of the present invention is to provide a new and improved conveyor system that permits independent travel of an unlimited number of carriers, without required carrier to carrier contact, without respect to gravity, and with a single drive means for the entire system of unlimited number of carriers.

A still further object of the present invention is to provide a new and improved power driven conveyor which can be operated in both directions with no dedicated directional means.

A still further object of the present invention is to provide a new and improved conveyor which when used in combination with electrical power and control can provide independent control and travel without individual electrical motors or individual drive devices for the carriers.

A still further object of the present invention is to provide a new and improved carrier for a power driven conveyor that has a contact surface which is movable into engagement with a drive means by having an actuator in the form of with an expandable device.

A still further object of the present invention is to provide a new and improved power driven conveyor where frictional force is dictated by dimensional design without reliance on gravity, and without the need to use fluid cylinders or springs to achieve the desired compression and resulting frictional force.

BRIEF DESCRIPTION OF THE DRAWINGS

The present invention can be achieved in accordance with one or more of the above objects. Other objects and advantages of the present invention will be more apparent from the following detailed description when taken with the accompanying drawings wherein.

DETAILED DESCRIPTION OF THE INVENTION

Figure 1:
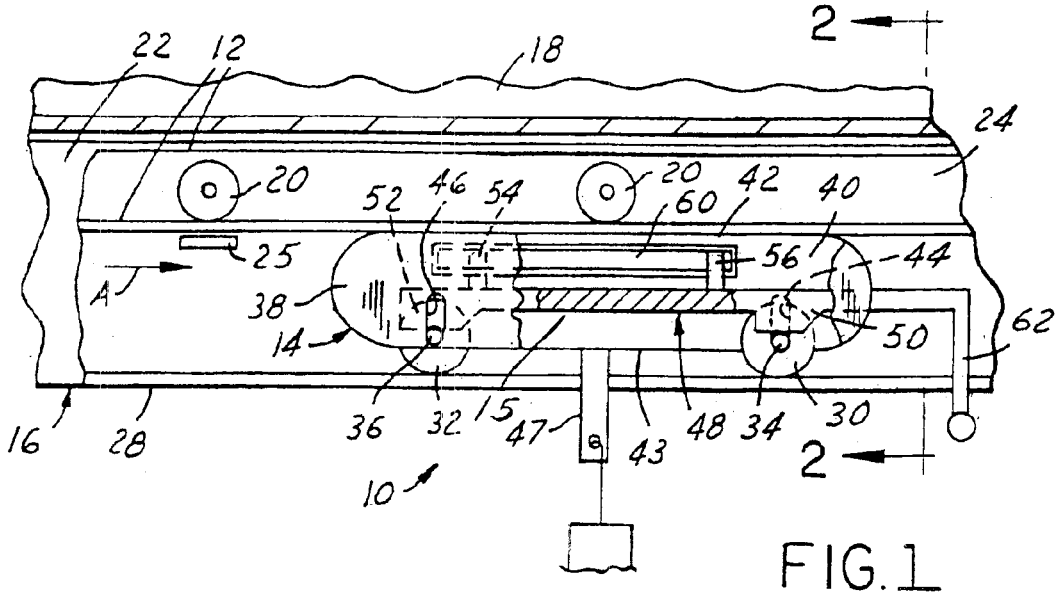
FIG. 1 is a side elevational view with some of the parts broken away showing the major components of one form of a power driven conveyor made according to the present invention.
Figure 2:
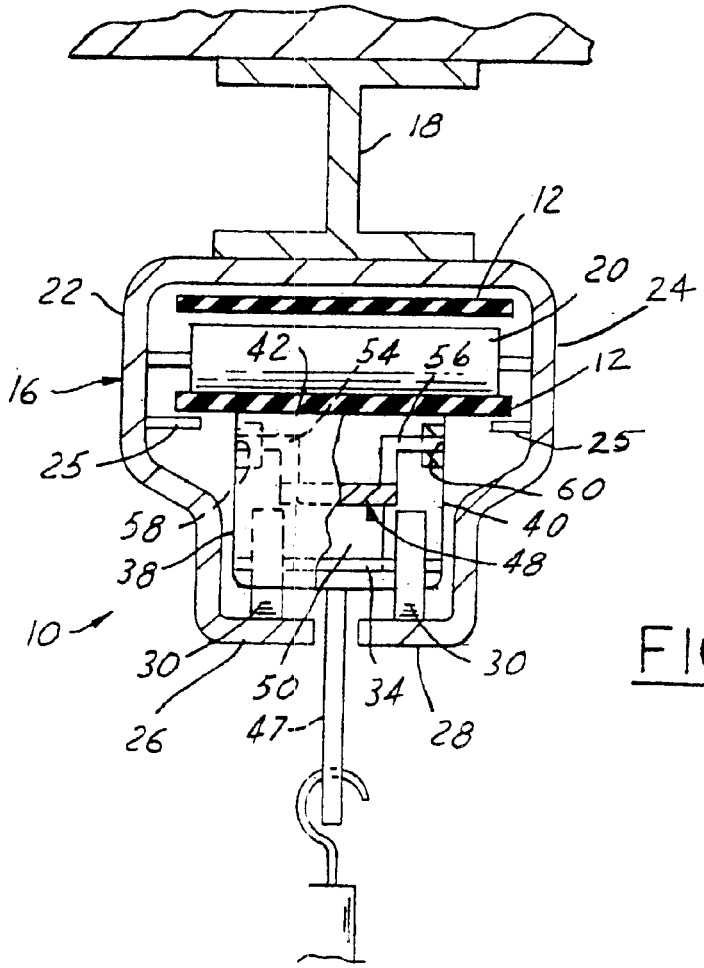
FIG. 2 is a cross sectional view of the power driven conveyor taken on line 2—2 of FIG. 1.
Figure 3:
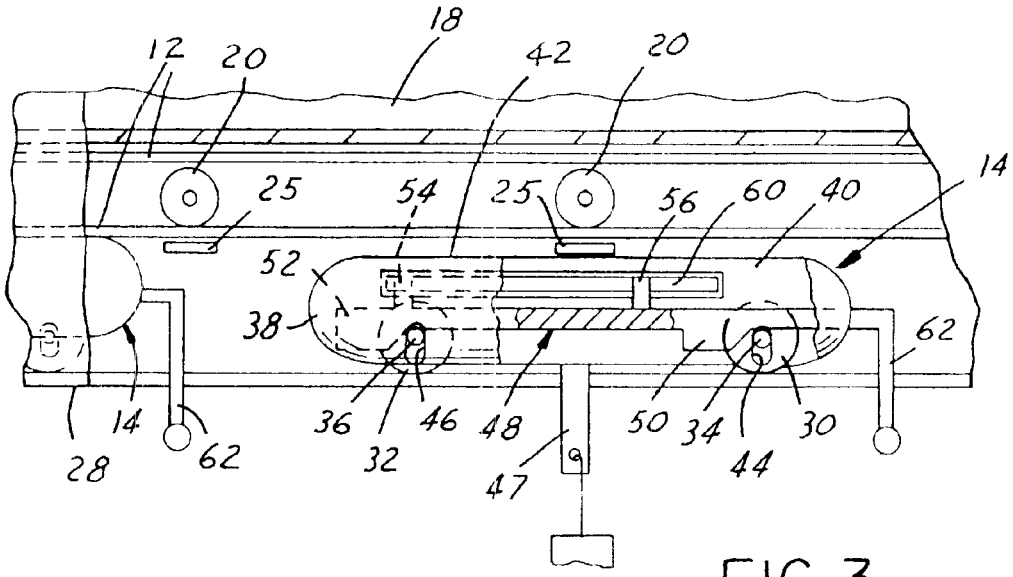
FIG. 3 is a view of the power driven conveyor of FIG. 1 but shows the article carrier disengaged from the drive means which forms a part of the conveyor.

Referring now to the drawings and more particularly FIGS. 1–3, a power driven conveyor 10 is shown that includes an endless continuous drive means such as an elastomeric belt 12 of typical industrial composition and in the form of an elongated loop. The belt 12 may be movable in either direction along the conveyor path but in this case has the lower portion of the belt 12 shown to be driven in the direction indicated by the arrow "A". The belt 12 can be driven by an electric motor and roller arrangement (not shown) located at one end of the conveyor. The belt 12 serves to selectively drive a plurality of essentially identical carriers one of which is shown in detail in FIGS. 1–3 and is identified as a unit by the reference numeral 14. Identically constructed carriers associated with the conveyor 10 are identified by the same reference numeral. When engaged with the belt 12, the belt 12 drives the carriers 14 along a path of travel that is parallel to the path of movement of the belt 12. An actuator 15 is connected to each carrier 14 for causing the carrier 14 to be engaged or disengaged from the belt 12 in a manner to be described hereinafter.

As best seen in FIGS. 1 and 2, the power driven conveyor 10 is provided with a support frame 16 the lower portion of which serves as a track for carriers 14. The frame 16, in this case, is shown having its upper end fixed to an I-beam 18 but, as should be apparent to those skilled in overhead conveyors, the frame 16 can be suspended by other support means that allow the frame 16 to maintain its path of travel as the carriers 14 move from an article loading station to an article unloading station. A plurality of back-up rollers 20 are supported for rotation by a pair of laterally spaced side walls 22 and 24 of the frame 16. The rollers 20 may not required, but the use of such rollers 20 is preferred to aid in keeping the belt 12 substantially planar during conveyor operation. If needed, inwardly extending tabs 25 can be secured to the sidewalls 22 and 24 at spaced intervals of the frame 16 for guiding the belt 12 during operation of the conveyor 10.

As seen in FIG. 2, the lower ends of the sidewalls 22 and 24 are turned inwardly to provide a track formed by frame sections 26 and 28 for a pair of front wheels 30 and a pair of rear wheels 32 of the carrier 14. The front wheels 30 and the rear wheels 32 are supported for rotation by transversely extending axles 34 and 36, respectively, which are connected to the associated body portion of each carrier 14. In this regard, the body portion of each carrier 14 is composed of side walls 38 and 40, an integrally formed top wall 41 having a substantially flat contact surface 42, and a bottom wall 43. The side walls 38 and 40 are provided with transversely aligned vertically extending slots 44 and 46 which respectively accommodate the opposed ends of the axles 34 and 36. In this case, the frame 16 provides the conveyor path for the wheels 30 and 32 of each carrier 14. It will be noted, however, that as an alternative to having a one-piece frame 16, the track formed by the sections 26 and 28 could be separate supports provided the dimensional relationship between the back-up rollers 20 and the travel surface can be reasonably maintained. Moreover, although the carrier 14 is provided with wheels 30 and 32, any low friction solid material which serves to meet the purpose of allowing movement of the carrier could be used. In addition, the carrier 14 is provided with a depending bracket 47 rigidly connected to the bottom wall 43 for supporting and transporting an article as shown from the loading station to the unloading station.

The actuator 15 located within the body of the carrier 14 comprises an elongated bar 48 integrally formed with a pair of longitudinally spaced and identical cam members 50 and 52. As seen in FIG. 2, the bar 48 is fixedly connected to two pairs of longitudinally spaced L-shaped transversely aligned arms 54 and 56 the outboard ends of which are located in longitudinally extending guide tracks 58 and 60 defined by upper and lower rails extending inwardly from the side walls 38 and 40. Although not shown, a detent is located at each end of one or the other guide track 58 or 60 for preventing the rolling motion or vibrations of the carrier 14 from causing the bar 15 from moving out of its pre-set positions shown in FIG. 1 and FIG. 3. The front end of the actuator 15 extends out of the body of the carrier 14 and is provided with a depending handle 62 which can be manually shifted between the positions seen in FIG. 1 and FIG. 3 for engaging the carrier 14 to or disengaging the carrier 14 from the belt 12 as will now be described.

In operation, the power driven conveyor 10 will initially have a carrier 14 located at a loading station and be disengaged from the belt 12 as seen in FIG. 3. After an article to be transported to an unloading station is placed on the bracket 47, the operator will grasp the handle 62 of the actuator 15 and manually move it to the right as seen in FIG. 3 so as to cause the cam members 50 and 52 to cooperate with the axles 34 and 36 to raise the bar 48 and, in turn, the body of the carrier 14 to the position seen in FIG. 1. In other words, the shifting movement of the actuator 15 causes the guide arms 54 and 56 to act upon the upper rail of each of the guide tracks 58 and 60 to raise the body of the carrier 14 vertically upwardly as dictated by the slots 44 and 46 and the opposed ends of the axles 34 and 36. When the body of the carrier 14 is raised relative to the track provided by the frame sections 26 and 28, the contact surface 42 of the carrier 14 makes frictional contact with the bottom surface of the moving belt 12 and is driven, as seen in FIG. 1, in the direction of the arrow "A" along with the belt 12. When the engaged moving carrier 14 arrives at the unloading station located at a point along the length of the conveyor 10, it can be automatically disengaged from the belt 12 and stopped in position by an electrically, mechanically, or manually operated pivoted bar (not shown) attached to the frame 16 and acting as a positive stop member for causing the handle 62 to be shifted to the position of FIG. 3. If a preceding carrier 14 is already in the stopped position at the unloading station as seen in FIG. 3, the moving carrier 14 trailing the stopped carrier will automatically stop when the handle 62 of the trailing carrier 14 makes contact with the rear end of the preceding or stopped carrier. As should be apparent, after the transported article is removed from the bracket 47 at the unloading station, the handle 62 of the actuator 15 can be manually shifted to the position of FIG. 1 so as to cause the contact surface 42 of the carrier 14 to again be frictionally engaged with the moving belt 12 and have the carrier continue its travel to another unloading station.

The conveyor 10 seen in FIGS. 1–3 lends itself particularly well to an arrangement where more than one carrier 14 is driven in a circular or oval path. If the conveyor 10 should be utilized in a circular or oval path of travel with more than one carrier 14, the belt would take the form of a round, rectangular, or square belt. In other words, the belt would be of uniform circular, rectangular or square cross section along its entire length and be dimensioned so that it could negotiate the curved sections of the circular or oval path. In addition, in order for the carrier 14 to be capable of traveling along a circular or oval path, the wheels 30 and 32 would be positioned outboard of the sidewalls 38 and 40 and be connected to their respective axles 34 and 36 by vertical hinges to allow the wheels to negotiate turns.

Figure 4:
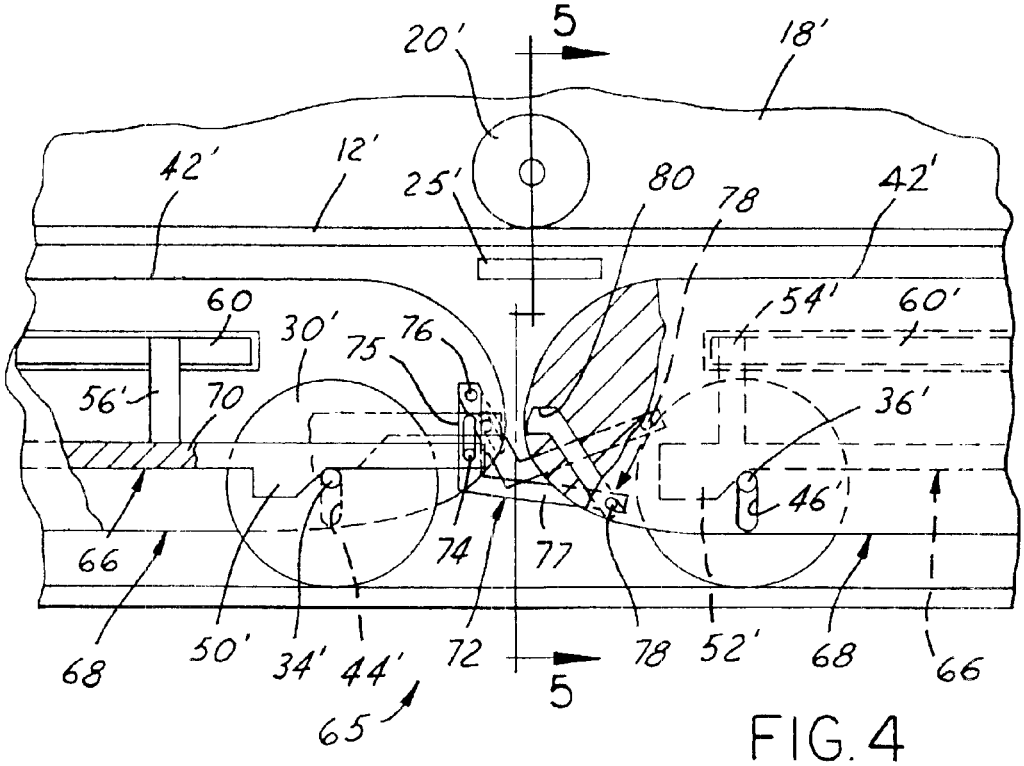
FIG. 4 is a partial elevational view of the power driven conveyor showing two article carriers each of which is similar in construction to the article carrier of FIGS. 1–3 and each of which is provided with a modified actuator permitting accumulation of the carriers.
Figure 5:
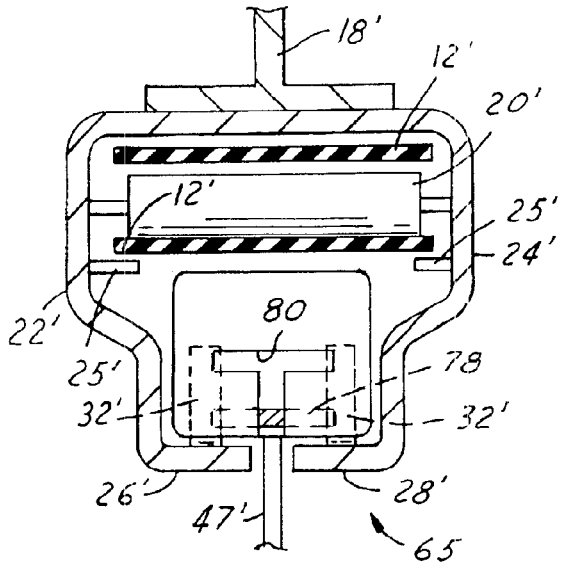
FIG. 5 is a sectional view taken on line 5—5 of FIG. 4.

FIGS. 4 and 5 show a power driven conveyor 65 that is the same in construction as the conveyor 10 shown in FIGS. 1–3 except for the use of a modified actuator 66 for accumulating a trailing carrier 68 with a preceding carrier 68. Accordingly, it will be noted that the parts of the conveyor 65 including those of its carriers 68 that correspond identically to the parts of the conveyor 10 and carrier 14 of FIGS. 1–3 are identified by the same references numerals but primed.

More specifically and as seen in FIGS. 4 and 5, the actuator 66 includes an elongated bar 70 the outer end of which is connected to an L-shaped lever 72 through a pin and slot connection 74. One leg 75 of the lever 72 is supported by the body of the carrier 68 by a pivotal connection 76 while the other leg 77 extends out of the front end of the carrier 68 and is provided with a transversely extending arm 78. The rear end of the preceding carrier is formed with a T-shaped opening 80 as seen in FIG. 5. The transverse portion of the opening 80 extends downwardly at an angle as seen in FIG. 4 and is adapted to receive the arm 78 of the lever 72 of the trailing carrier 68 when the preceding carrier 68 is in a stopped position as seen in FIG. 4. Thus, it should be apparent that when the lever 72 is located in the dotted line position, the bar 70 of the actuator 66 will be in the position of FIG. 1 and the contact surface 42' will be frictionally engaged with the belt 12'. As the moving trailing carrier 68 comes into contact with the preceding carrier 68 which is in the stopped position, the arm 78 moves into the upper end of the guide opening 80 and slides downwardly to the full line position shown in FIG. 4 and causes the lever 72 rotate counterclockwise about the pivotal connection 76. As a result, the bar 70 and the associated cam members 50' and 52' move to the position of FIG. 3 and cause the body of the associated carrier 68 to be disengaged from the belt 12' as seen in FIG. 4. The same guide opening 80 will reestablish the raised position of the arm 78 causing clockwise rotation of the lever 72 when the preceding carrier moves forwardly as in the resumption of travel. This operation is accomplished without the requirement for gravity, which permits functionality in inclined or inverted conveyor paths.

Figure 7:
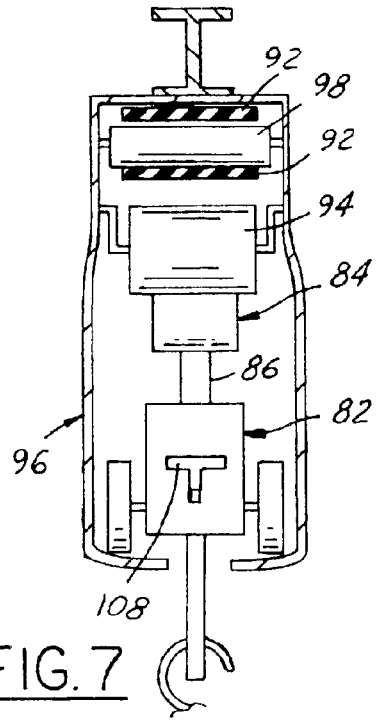
FIG. 7 is a sectional view taken on line 7—7 of FIG. 6.
Figure 6:
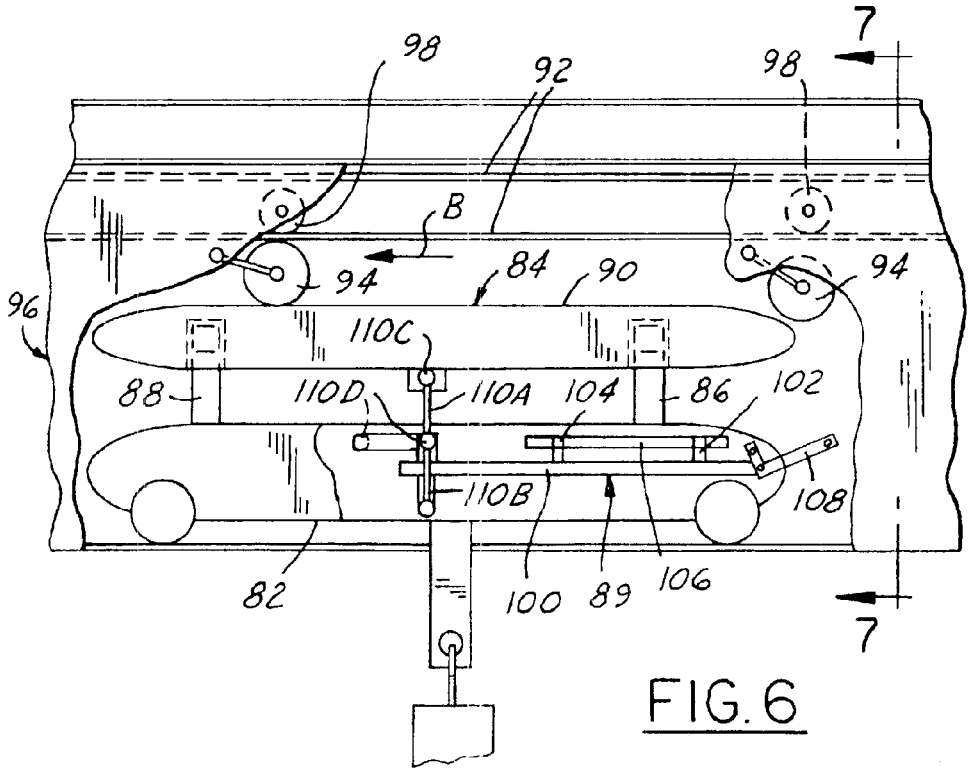
FIG. 6 is a side elevation view of a modified form of the power driven conveyor according to the present invention.

FIGS. 6 and 7 disclose another form of the power drive conveyor shown in FIGS. 1–5. As seen in FIGS. 6 and 7, rather than having the entire body of the carrier move selectively as a unit into and out of frictional contact with a moving belt as described above in connection with the conveyor systems seen in FIGS. 1–5, a carrier 82 is provided that has a collapsible head portion 84. The head portion 84 is supported by a pair of pins 86 and 88 and is movable vertically between the raised position shown and a lowered position (not shown) through an actuator mechanism 89 mounted within the carrier 82. In addition, instead of having the head portion 84 have its contact surface 90 engage a moving belt 92 directly, the contact surface 90 progressively and successively engages a plurality of identical pinch rollers 94 strategically spaced along the path of travel of the power driven conveyor. As best seen in FIG. 7, each pinch roller 94 is pivotally connected to the support frame 96 of the conveyor and normally is suspended in a position out of engagement with the belt 92 and with the contact surface 90 when the head portion 84 is in the lowered position. However, with the lower part of the belt 92 being driven in the direction indicated by the arrow "B" and when the head portion 84 of the carrier is in the raised position, the contact surface 90 will contact a pinch roller 94 and press it into engagement with the moving belt 92. When this occurs, the driven belt 92 will be compressed between the pinch roller 94 and a back-up roller 98 and transfer drive through the counter-clockwise rotating pinch roller 94 to the carrier 82 to cause it to be driven along the track portion of the frame 96 in a direction opposite to the direction of the driven belt 92. In this regard, it will be noted that, as seen in FIG. 6, the spacing of the pinch rollers 94 is such that before the driven pinch roller 94 reaches a point where it would lose contact with the contact surface 90 of the head portion 84, the next pinch roller 94 will come into contact with the contact surface 90 and, in this manner, continue to provide drive to the carrier 82. The pinch rollers 94 are shown with a preferable swing mounting to permit low force engagement and rotation against the contact surface 90 of the carrier 82 prior to swinging upward for high force engagement with the belt 92. This swing mounting serves to reduce wear by permitting speed match of the pinch roller 94 with the belt 92 prior to engagement, and such reduction of wear could also be achieved with a slide mounting. A compressible pinch roller 94 of urethane or like materials permits use of rigid materials for back-up rollers 98. It will be noted that a pinch roller 94 of rigid highly wear-resistant material would permit use of a belt as the only compressible wearable embodiment in the conveyor. It will also be noted that the pinch rollers 94 serve to transform the sliding friction of FIG. 1 to the rolling friction of FIG. 6 and therefore become an extension and, in effect, the drive means when engaged with the belt 92.

As seen in FIG. 6, the actuator mechanism 89 operatively associated with the carrier 82 includes a longitudinally movable bar 100 having a pair laterally spaced arms 102 and 104 supported within a guide tracks 106 formed on the side walls of the carrier 82 in the manner of the arms 54 and 56 of the carrier 14. Extending out of the front end of the carrier 82 is a lever 108 which is connected to the front end of the bar 100 and the body of the carrier 82 in the same manner as the lever 72 associated with the carrier 68 of FIGS. 4 and 5. Accordingly, when the outer end of the lever 106 is moved downwardly, the bar 100 is shifted to the left and operates through a linkage 110 to cause the head portion 84 to be lowered under the guidance of the pins 86 and 88 to a position where the contact surface 90 is at a level where it does not engage any of the pinch rollers 94 with the belt 92. In this position of the head portion 84 of the carrier 82 is in a stopped condition for loading or unloading an article as explained in connection with the conveyor 10 seen in FIGS. 1–3. The linkage 110 includes links 110A and 110B with link 110A being connected to head portion 84 by a pivotal connection 110C and the two links 110A and 110B being interconnected at pivotal connection 110D. During movement of the bar 89 as mentioned above, pivotal connection 110D moves within a horizontal guide track to the dotted line position while the lower end of link 110B moves within a vertical guide track.

Figure 8:
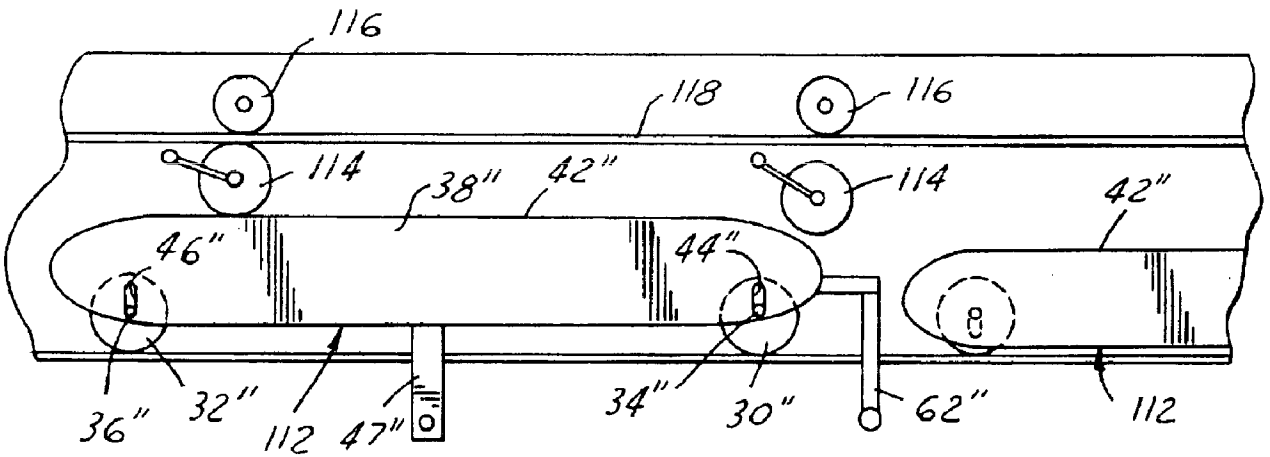
FIG. 8 is side elevational schematic view of another form of the power driven conveyor according to the present invention.

FIG. 8 shows schematically a pinch roller type power driven conveyor in which the carriers 112 are identical in structure to the carriers 14 of FIGS. 1–3 and, therefore, the parts corresponding to the parts of the carrier 14 are identified by the same reference numerals but double primed. In this case, rather than having a separate head portion such as seen in FIG. 7 that moves relative to the body of the carrier, the body of the carrier 112 will raise upwardly, as explained in connection with the carriers 14, to have the contact surface 42" of the carrier 112 contact successively the pinch rollers 114 acting with back-up rollers 116 and be driven by the belt 118 in the manner described in connection with the conveyor seen in FIGS. 6 and 7.

Figure 9:
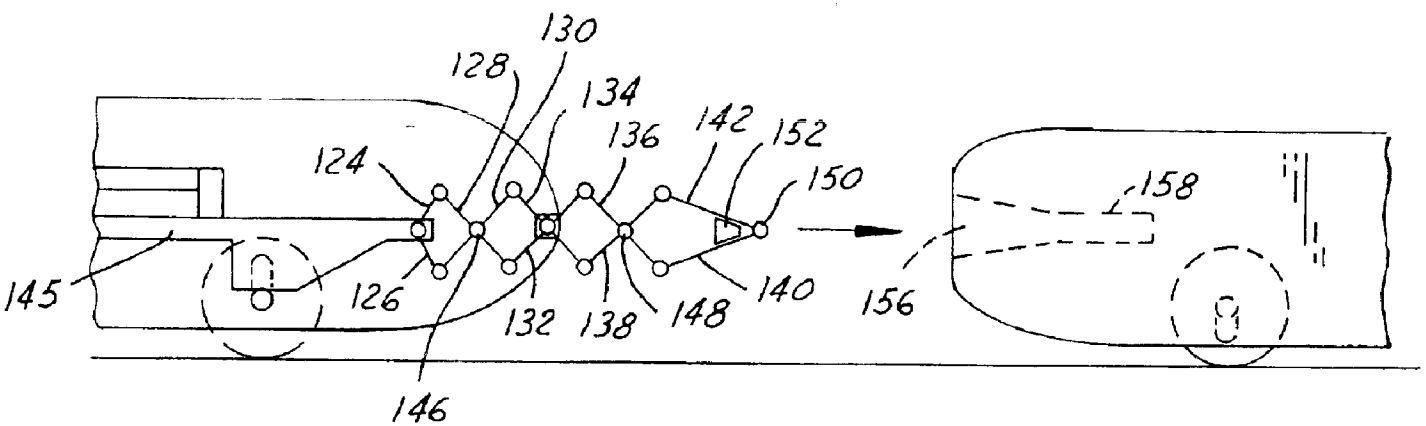
FIG. 9 is a side elevational schematic view of an article carrier similar to that shown in FIGS. 4 and 5 but provided with another form of actuator that allows the article carriers to accumulate.

FIG. 9 shows schematically a scissors-type device 120 which can be employed at the front end of any of the carriers described above for moving the bar of the actuator rearwardly and causing the contact surface of the carrier to be disengaged from the moving belt when the trailing carrier encounters a stopped preceding carrier. The device 120 is shown attached at a pivot point 122 to the body 124 of the trailing wheeled carrier and comprises link members 124–142. The link members 124 and 126 are interconnected at a pivot point 144 fixed with the forward end of the bar 145, the link member 128 and 130 are interconnected at the pivot point 146, the link members 132 and 134 are interconnected at the fixed pivot point 122, link members 136 and 138 are interconnect at a pivot point 148, and link members 140 and 142 are interconnected at a pivot point 150. A rubber pad 152 is located between the link members 140 and 142 for permitting the device 120 to normally be in the open position seen in FIG. 9. As seen in FIG. 9, the preceding carrier is assumed to be in a stopped condition disengaged from the moving belt (not shown) and is provided with a female opening having an enlarged entrance area 156 that leads to a narrower tapered area 158. Accordingly, when the interconnected link members 140 and 142 move into the entrance area 156 and then into the tapered area 158, the link members 124–142 will collapse in a scissors fashion and through the fixed pivot point 122 cause the bar 145 to move rearwardly to cause the contact surface of the carrier to be disengaged from the belt. When the preceding carrier is re-engaged with the belt and starts to move forwardly relative to the trailing carrier, the link members 140 and 142 of the device 120 revert to the expanded position shown in FIG. 9 by reason of the expanding action of the pad 152. This action then causes the bar 145 to move to the position shown in FIG. 9.

Figure 10:
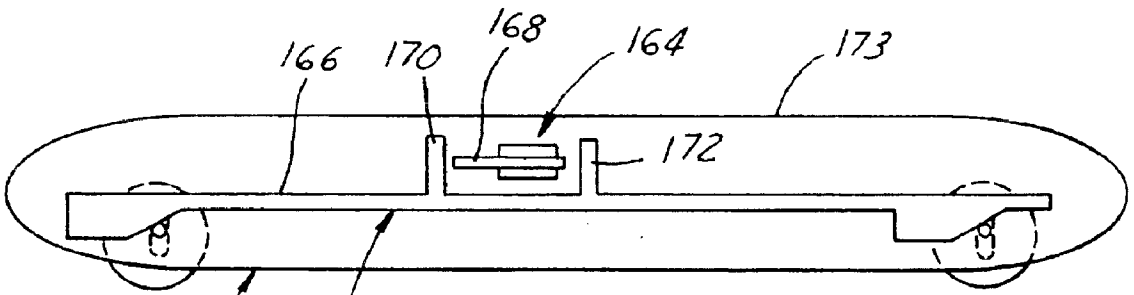
FIG. 10 is a side elevational schematic view of an article carrier similar to that shown in FIGS. 1–3 but provided with an electrically-operated actuator.

The carrier 160 seen in FIG. 10 is intended to be constructed the same as the carrier 14 seen in FIG. 1 except for the actuator 162 which is provided with a electric solenoid 164 for moving the bar 166 of the actuator between the a contact-surface-engaged position and a contact-surface-disengaged position. As seen in FIG. 10, the solenoid 164 includes a plunger 168 which cooperates with a pair of upstanding legs 170 and 172 fixed with the bar 166 for moving the bar 166 between the position shown wherein the contact surface of the carrier 160 would be disengaged from the belt and a raised position wherein the contact surface would be engaged with the belt as hereinbefore explained in connection with the carrier 14 seen in FIGS. 1–3. The electrical solenoid 164 would receive electrical power via a buss bar or similar travel permissive power distribution system. Control or activation of the electrical device could be achieved by simple on/off power application or inverting the polarity of power, or by an onboard programmable logic controller. Any of these serves to permit independent carrier stoppage and travel without fixed mechanical stops or actuation, without accumulation of carriers and without individual electrical motors for each carrier. It will be understood that a solenoid is an electro-magnetic device and can be replaced by an electro-magnet without a plunger to move metal legs, such as legs 170 and 172, by magnetic force thereby providing non-contact actuation. The electromagnet could be fixed at a station to provide indexing of the legs via magnets.

Figure 12:
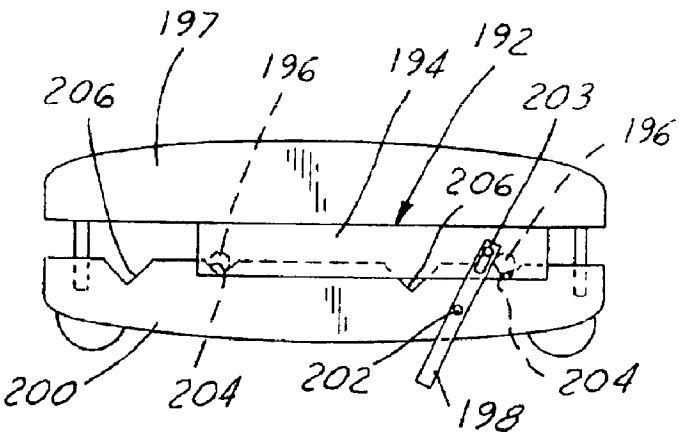
FIG. 12 is a side elevational schematic view of an article carrier similar to that seen in FIGS. 6, 7, and 11 but provided with a further modified actuator.
Figure 11:
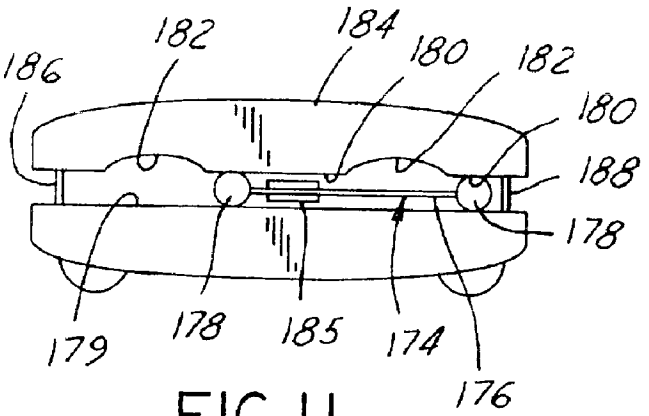
FIG. 11 is a side elevational schematic view of an article carrier similar to that seen in FIGS. 6 and 7 but provided with a modified actuator.

Each of FIGS. 11 and 12 show a modified form of actuator for raising the head portion of a carrier such as the carrier 82 seen in FIGS. 6 and 7. As seen in FIG. 11, the actuator 174 includes a cylindrical rod 176 the opposed ends of which is provided with a circular cam 178. The cams 178 are adapted to slide along a horizontal flat surface 179 and cooperate with flat horizontally aligned surfaces 180 and concave surfaces 182 for raising and lowering the head portion 184 of the carrier. The movement of the head portion 184 is controlled by vertical pins 186 and 188. An electrically operated tubular solenoid 185 serves to provide longitudinal movement of the rod 176 so as to cause the head portion 184 to move between the raised and lowered positions. In another mode, an electrical or magnetic device could also directly expand and collapse the head portion 184 of load-supporting portion without the combination of a cam-like device. In still another mode, a linkage could directly connect the movable head portion 184 to the body of the carrier and thereby eliminate the guide pins 186 and 188.

The carrier seen in FIG. 12 includes an actuator 192 which comprises a longitudinally movable member 194 that supports a pair of identical circular cams 196 and is in surface to surface contact with the flat under side of the head portion 197. A hand-operated lever 198 is pivotally connected to the wheeled portion 200 of the carrier at a point 202 and operates through a pin and slot connection 203 to shift the member 194 from the position shown wherein the cams 196 are located in shallow V-shaped notches 204 to a position wherein the cams 196 are located in V-shaped deep notches 206. It should be apparent that when the cams 196 are in the notches 204, the head portion 197 of the carrier is in the raised position for engagement with the belt and when the cams 196 are located in the notches 206, the head portion 197 is in the lowered position out of engagement with the belt.

Figure 13:
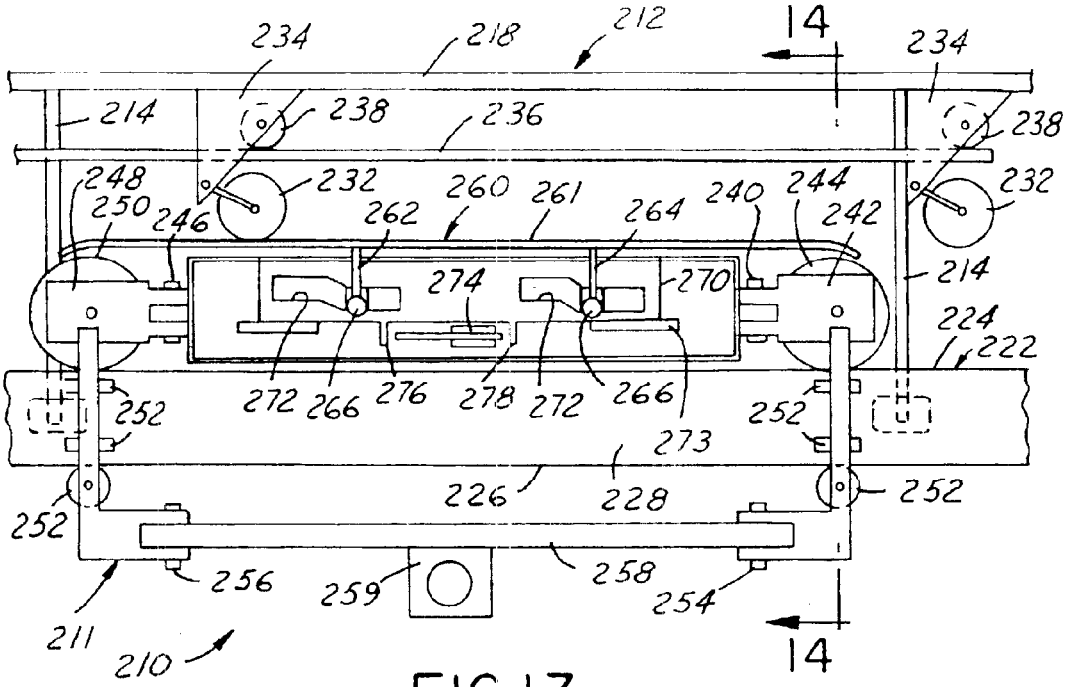
FIG. 13 is a side elevational view of another modified version of the power driven conveyor made according to the present invention.
Figure 14:
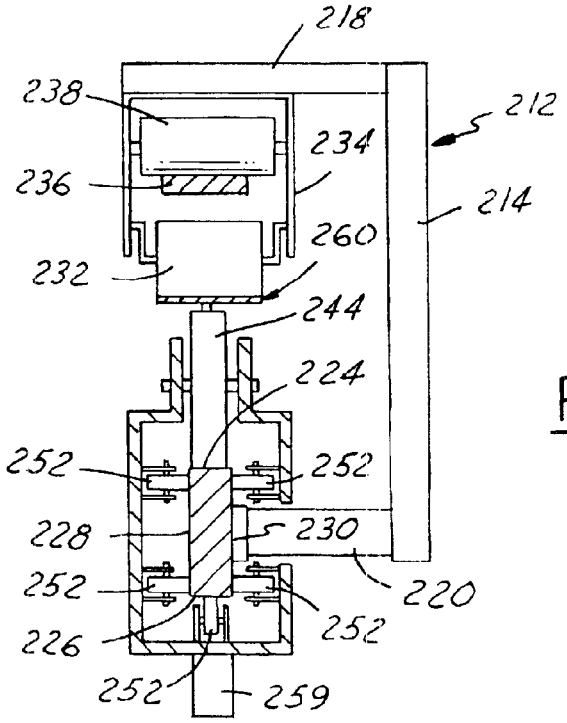
FIG. 14 is a sectional view of the modified version of the power driven conveyor taken on line 13—13 of FIG. 13.

FIGS. 13 and 14 illustrate a power driven conveyor 210 having a load supporting carrier 211 primarily intended for use with a circular or oval track or a track requiring the carrier to negotiate curves in the track. The conveyor 210 includes a support frame 212 which consists of a plurality of spaced vertical sections 214 located along the path of travel of a carrier 211. The upper end of each section 214 is rigidly the secured to the ceiling or to a horizontally disposed plate portion 218 of the frame 212 that, in turn, can be rigidly connected to an stationary overhead I-beam or the like (not shown). The lower end of each section 214 is fixed with a laterally extending arm 220 which serves to support a track 222 which, in this instance and as best seen in FIG. 14, takes the form of a rectangular member in cross section that has a top wall 224, a bottom wall 226, and a pair of laterally spaced sidewalls 228 and 230. As in the case of the conveyor 82 seen in FIGS. 6 and 7, the plate portion 218 of the frame 212 supports a plurality of identical pinch rollers 232 spaced along the path of travel of the carrier 211. Each pinch roller 232 is pivotally connected to the plate portion 218 by a triangularly shaped housing 234 as seen in FIG. 13 and is normally suspended in a position out of engagement with an endless continuous belt 236 which is rectangular in cross-section and designed so that it is able to negotiate turns. Each housing 234 also supports a back-up roller 238 directly above the pinch roller 232 and on the opposed side of the belt 236.

The carrier 211 is adapted to travel along the track 222 as it moves from a loading station to one or more unloading stations. More specifically, the carrier 211 includes a body one end of which is connected by a hinge 240 to a clevis 242 which supports a wheel 244 for rotation along the track 222. The other end of the carrier body is similarly connected by a hinge 246 to a clevis 248 which supports a wheel 250 for rotary movement along the track 222. As seen in FIG. 14, the clevis 242, 248 of each wheel 244, 250 is an integral part of a roller housing provided with five identical rollers each of which is identified by reference numeral 252. The two roller housings serve to stabilize and guide the carrier 211 as in travels along the track 222. In this regard, it will be noted that two of the rollers 252 are in rolling contact with the sidewall 228 of the track 222, another two of the rollers 252 are in rolling contact with the sidewall 230, and one roller 252 is in rolling contact with the bottom wall 226.

The lower ends of the two roller housings are connected through hinges 254 and 256 to an elongated beam 258 having a bracket 259 which is intended to support the article being transported by the carrier 211. In this case, the vertical pivot axes of the hinges 240 and 246 are vertically aligned with the pivot axes of the hinges 254 and 256, respectively, so as to allow the wheels 244 and 250 to negotiate turns as the carrier 211 travels along curved sections of the track 222.

The body portion of the carrier 211 is provided with a movable head portion 260 having a flat contact surface 261 except for the downwardly curved sections at each end of the head portion 260. As seen in FIG. 13, the head portion 260 is supported by a pair of vertical rods 262 and 264 the lower end of each of which is provided with a transversely extending pin 266 supported within transversely aligned vertical slots 268 formed in the sidewalls of the body of the carrier 211. A bar 270 is supported within the interior of the body of the carrier 211 for sliding movement along the longitudinal axis of the carrier 211 and is provided with a pair of spaced and identical cut-out portions 272. As seen in FIG. 13, the cut-out portions 272 are configured so as to serve as cams so when the bar 270 is shifted to the right under the guidance of tabs 273 fixed with the sidewalls of the carrier body, the pins 266 and connected rods 262, 264 are simultaneously raised vertically upwardly to cause the head portion 260 of to be similarly raised. As should be apparent, when the head portion 260 is raised upwardly, the contact surface 261 will engage the pinch roller 232 and cause it to be pivoted in a counter-clockwise direction into engagement with the belt 236. This then causes the belt 236 to be compressed between the pinch roller 232 and the back-up roller 238. The linear movement of the belt 236 is transformed into rotary movement of the pinch roller 232 which, by way of frictional engagement with the contact surface 261 of the head portion 260 provides driving movement to the carrier 211 along the track 222 in a manner as described above in connection with the conveyor arrangements shown in FIGS. 6–8. As in the case of the carrier 160 of FIG. 10, an electric solenoid 274 mounted on the body of the carrier 211 cooperates with a pair of depending legs 276 and 278 fixed with the bar 270 for moving the bar 270 between the position shown in FIG. 13 wherein the head portion 260 is in the lowered position and the raised position of the head portion 260 described above.

Figure 15:
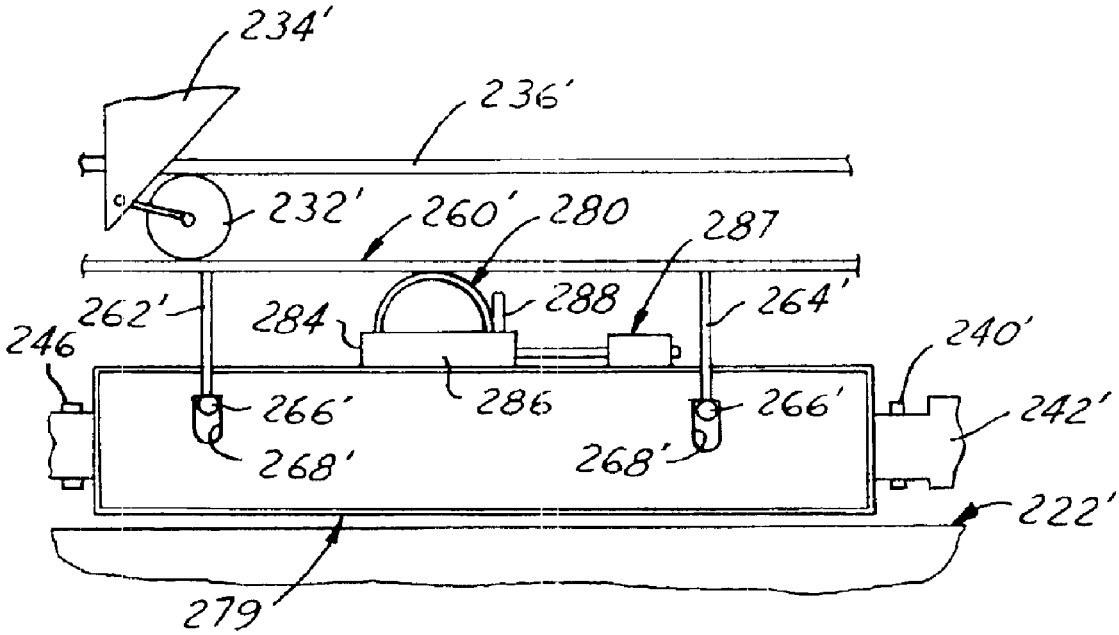
FIG. 15 is a view of a modified actuator arrangement usable with the carriers seen in FIGS. 6, 7, 13 and 14.

FIG. 15 depicts a carrier 279 of the type seen in FIGS. 13 and 14 except for the use of a modified form of actuator for raising the head portion for engagement with the pinch rollers. Accordingly, those parts of the carrier 279 that correspond with the parts of the carrier 211 seen in FIGS. 13 and 14 are identified by the same reference numerals but primed.

As seen in FIG. 15, a flexible bladder or balloon member 280 filled with a fluid is mounted on the top surface of the body of the carrier 279. It will be understood that the bladder 280 is confined within a defined generally rectangular area by three stationary sidewalls (only two sidewalls 284 and 286 are shown) on three sides of the bladder 280. A power-operated device 287 is connected to a movable sidewall 288 which is provided as the fourth sidewall on the top surface of the body surrounding the bladder 280. The sidewall 288, when moved toward the left, serves to squeeze or compress the bladder 280 causing the bladder 280 to expand upwardly in a vertical direction due to the confining action of the three stationary sidewalls. As the bladder 280 moves upwardly, it raises the head portion 260' into a driven engagement with the pinch roller 232'. When the side wall 288 is moved away from the bladder 280, the pressure on the bladder 280 is relieved and the head portion 260' is permitted to be lowered by gravity out of engagement with the pinch roller 232'. As should be apparent, the sidewall 288 can be moved for compressing the bladder 280 through an electrically or fluid operated plunger or a screw device or through a manually operated mechanical device. In addition, rather than having a fluid filled bladder 280, a solid member made of a compressible elastomeric material such as rubber can be substituted for the bladder 280.

Figure 16:
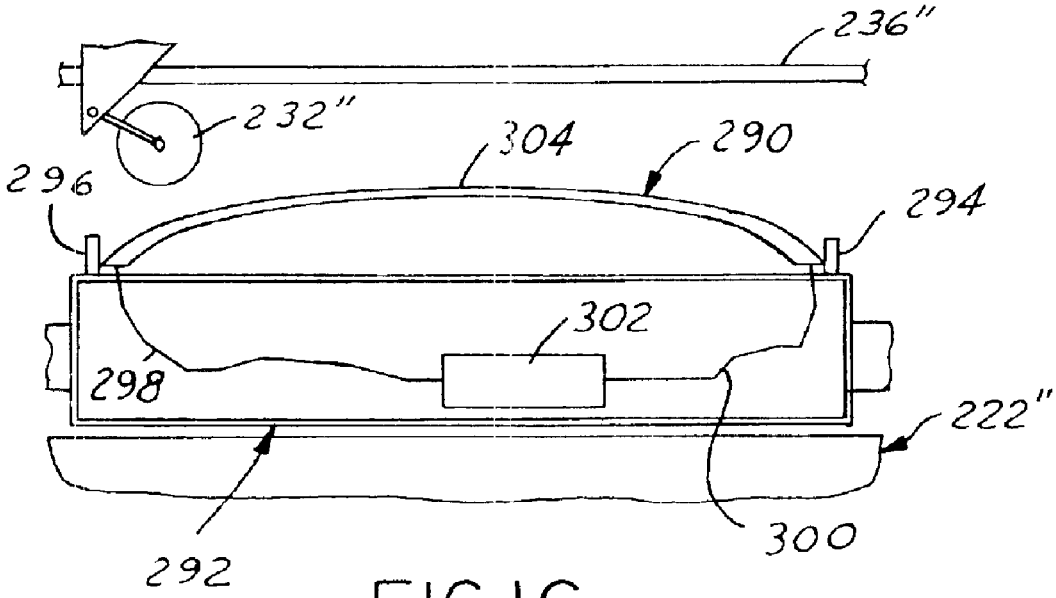
FIG. 16 is a view of a further modified actuator arrangement usable with the carriers of FIGS. 6, 7, 13 and 14.

FIG. 16 shows a further modified version of an actuator arrangement that can be applied to a carrier such as the carrier 211 seen in FIGS. 13 and 14. In this instance, the actuator consists of a bowed metallic member 290 positioned on the top surface of the body of a carrier 292. The longitudinally spaced ends of the member 290 are adapted to be confined by end walls 294 and 296 secured to the top surface of the body of the carrier 292 and are connected by electrical wires 298 and 300 to a source 302 of electrical power. It will be understood that the member 290 can be bimetallic in construction or other form of a specialized metal which expands when heated by electrical current. Thus, with an arrangement of this sort, when the member 290 is subjected to heat induced by electrical current, the member 290 will tend to elongate and, due to the confining walls 294 and 296, cause its center section to raise upwardly into contact with a driven pinch roller or belt. Thus, in this case, the member 290 serves a dual function, namely, acting as the actuator and the providing a contact surface 304 for the carrier 292 and for inter-action with the pinch rollers or belt of a power driven conveyor. In addition, convection or radiant heat thermal expansion of the member represents a non-contact control in that no mechanical connection is required for the expansion or contraction of the member 290.

It should be noted that the actuators of FIGS. 15 and 16 can also be applied to the carriers seen in FIGS. 6 and 7. Moreover, it should be understood that each of the pinch rollers of the conveyors seen in FIGS. 6, 8, and 13 can be provided with a sprocket at one end thereof and be driven by an endless chain if one should desire to eliminate the use of a belt.

Other various changes and modifications can be made to the new and improved power driven conveyors described above without departing from the spirit of the invention. Such other changes and modifications are contemplated by the inventor and he does not wish to be limited except by the scope of the appended claims.

What is claimed is:

1. A power driven conveyor having a drive means, a carrier supported for movement along a path of travel parallel to the path of movement provided by said drive means, said carrier having a contact surface adjacent to said drive means that is movable between a first position wherein said contact surface is disengaged from said drive means and a second position wherein said contact surface is frictionally driven by said movable drive means so as to cause said carrier to move along said path of travel provided by said drive means, and an actuator operatively associated with said carrier for causing said contact surface to move between said first position and said second position, wherein said drive means comprises a plurality of rollers located at the other side of a continuous movable belt which successively transfers drive through said rollers when said contact surface is in said second position.

2. The power driven conveyor of claim 1 wherein said carrier is bodily movable by said actuator for causing said contact surface to engage said drive means.

3. The power driven conveyor of claim 1 wherein said contact surface is movable relative to the main body of said carrier for engagement with said drive means.

4. The power driven conveyor of claim 1 wherein said actuator includes a compressible member that changes its configuration when subjected to a compressive force.

5. The power driven conveyor of claim 1 wherein said actuator includes a thermally expansive member that changes its configuration when subjected to an induced heat.

6. The power driven conveyor of claim 1 wherein said carrier is provided with hinged wheels for negotiating curves encountered along the path of travel of said carrier.

7. The power driven conveyor of claim 1 wherein said actuator is shiftable by non-contact means between two points for moving said contact surface between said first position and said second position.

8. The power driven conveyor of claim 1 wherein the level of frictional force providing movement of said carrier is determined through varying the dimensional design relationship of said contact surface in said second position relative to the drive means.

9. A power driven conveyor having a drive means, a carrier supported for movement along a path of travel parallel to the path of movement provided by said drive means, said carrier having a contact surface adjacent to said drive means that is movable between a first position wherein said contact surface is disengaged from said drive means and a second position wherein said contact surface is frictionally driven by said movable drive means so as to cause said carrier to move along said path of travel provided by said drive means, and an actuator operatively associated with said carrier for causing said contact surface to move between said first position and said second position, wherein said actuator is shiftable by non-contact means between two points for moving said contact surface between said first position and said second position, and wherein said actuator includes a portion adapted to engage a preceding stopped carrier and cause said actuator to be activated so as to cause said contact surface of said carrier to be moved between said second position and said first position.

10. The power driven conveyor of claim 9 wherein said portion is adapted to move within an opening formed in said rear end of said preceding stopped carrier so as to cause said actuator to be activated.

11. The power driven conveyor of claim 9 wherein the level of frictional force providing movement of said carrier is determined through varying the dimensional design relationship of said contact surface in said second position relative to the drive means.

12. A power driven conveyor having a plurality of rotatable and pivotably supported pinch rollers providing a path of travel for a load supporting carrier, said carrier having a contact surface adjacent to said pinch rollers that is movable between a first position wherein said contact surface is spaced from said pinch rollers and a second position wherein said surface successively frictionally engages said pinch rollers to provide drive thereto so that said carrier is moved along said path of travel provided by said pinch rollers, and an actuator connected to said carrier for moving said contact surface of said carrier between first position and said second position.

13. The power driven conveyor of claim 12 wherein said actuator includes a compressible member which changes its configuration when subjected to a compressive force.

14. The power driven conveyor of claim 12 wherein said actuator includes a thermally expansive member that changes its configuration when subjected to an induced heat.

15. The power driven conveyor of claim 12 wherein said carrier is provided with hinged wheels for negotiating curves encountered along the path of travel of said carrier.

16. The power driven conveyor of claim 12 wherein a continuous movable belt is adapted to provide rotation to said pinch rollers when said contact surface is in second position.

17. The power driven conveyor of claim 12 wherein said carrier is bodily movable for causing said contact surface to frictionally engage said pinch rollers.

18. The power driven conveyor of claim 17 wherein said carrier is supported by wheels mounted on an axle which cooperates with cam members forming a part of said actuator so as to permit said contact surface of said carrier to be movable between said first position and said second position.

19. The power driven conveyor of claim 18 wherein said cam members of said actuator are part of a longitudinally movable bar supported by said carrier.

20. The power driven conveyor of claim 19 wherein said bar includes a device having a portion externally mounted on said carrier that is adapted to engage a preceding stopped carrier and cause said device to shift said bar so that said contact surface of said trailing carrier is moved between said second position and said first position.

21. The power driven conveyor of claim 20 wherein said device is adapted to move into an opening formed in a rear end of said preceding stopped carrier so as to cause said bar to be shifted in said one direction.

22. The power driven conveyor of claim 21 wherein said opening in said preceding carrier is formed so as to permit said device to resume it original position when said preceding stopped carrier has its contact surface engaged with and driven by said pinch rollers.

23. The power driven conveyor of claim 17 wherein said carrier is supported by wheels mounted on an axle which cooperates with cam members forming a part of said actuator so as to permit said contact surface of said carrier to be movable between said first position and said second position, said cam members of said actuator are part of a longitudinally movable bar supported by said carrier, said bar includes a device having a portion externally mounted on said carrier that is adapted to engage a preceding stopped carrier and cause said device to shift said bar so that said contact surface of said trailing carrier is moved between said second position and said first position.

24. The power driven conveyor of claim 23 wherein said device is adapted to move into an opening formed in a rear end of said preceding stopped carrier so as to cause said bar to be shifted in said one direction.

25. The power driven conveyor of claim 24 wherein said opening in said preceding carrier is formed so as to permit said device to resume it original position when said preceding stopped carrier has its contact surface engaged with and driven by said pinch rollers.

26. The power driven conveyor of claim 12 wherein said contact surface is movable relative to the main body of said carrier.

27. The power driven conveyor of claim 12 wherein said actuator for moving said contact surface of said carrier between said first position and said second position is mechanically operated.

28. The power driven conveyor of claim 12 wherein said actuator for moving said contact surface of said carrier between said first position and said second position is electrically operated.

29. A power driven conveyor having a plurality of rotatable pinch rollers providing a path of travel for a load supporting carrier, said carrier having a contact surface adjacent to said pinch rollers that is movable between a first position wherein said contact surface is spaced from said pinch rollers and a second position wherein said contact surface successively frictionally engages said pinch rollers to provide drive thereto so that said carrier is moved along said path of travel provided by said pinch rollers, and an actuator for moving said contact surface of said carrier between said first position and said second position.

30. The power driven conveyor of claim 29 wherein said pinch rollers are movably supported.

31. The power driven conveyor of claim 30 further including an elongated movable member extending parallel to said path of travel adapted to be frictionally engaged by said pinch rollers when said pinch rollers are frictionally engaged by said contact surface to provide the drive to the pinch rollers.

32. The power driven conveyor of claim 31 wherein said pinch rollers are located above said carrier and said movable member is located above said pinch rollers.

33. The power driven conveyor of claim 29 wherein said actuator is shiftable by non-contact means for moving said contact surface between said first position and said second position.

34. The power driven conveyor of claim 29 wherein said actuator includes a compressible member which changes its configuration when subjected to a compressive force.

35. The power driven conveyor of claim 29 wherein said actuator includes a thermally expansive member that changes its configuration when subjected to an induced heat.

36. The power driven conveyor of claim 29 wherein a continuous movable belt is adapted to provide rotation to said pinch rollers when said contact surface is in second position.

37. The power driven conveyor of claim 29 wherein said carrier is bodily movable for causing said contact surface to frictionally engage said pinch rollers.

38. The power driven conveyor of claim 29 wherein said contact surface is movable relative to the main body of said carrier.

39. The power driven conveyor of claim 29 wherein said actuator for moving said contact surface of said carrier between said first position and said second position is mechanically operated.

40. The power driven conveyor of claim 29 wherein said actuator for moving said contact surface of said carrier between said first position and said second position is electrically operated.

41. The power driven conveyor of claim 29 wherein the level of frictional force providing movement of said carrier is determined through varying the dimensional design relationship of said contact surface in said second position relative to said pinch rollers.

42. A power driven conveyor having drive means movable along a predetermined path, a carrier supported beneath said drive means for movement along a path of travel parallel to the path of said drive means, said carrier having a contact surface adjacent to said drive means that is movable between a lower position wherein said contact surface is spaced downwardly from said drive means and an upper position wherein said contact surface engages said drive means so as to cause said carrier to be moved by said drive means along said path of travel, and an actuator for moving said contact surface between said lower position and said upper position.

43. The power driven conveyor of claim 42 wherein said drive means comprised an elongated continuous movable belt above said carrier having one side frictionally engaged by said contact surface in the upper position of said contact surface.

44. The power driven conveyor of claim 43 further including backup rollers on a side of said movable belt opposite said one side thereof.

45. The power driven conveyor of claim 43 wherein said carrier is bodily movable by said actuator for causing said contact surface to engage said belt.

46. The power driven conveyor of claim 43 wherein said contact surface is movable relative to a main body portion of said carrier for engagement with said belt.

47. The power driven conveyor of claim 42 wherein the level of frictional force providing movement of said carrier is determined through varying the dimensional design relationship of said contact surface in said second position relative to the drive means.

* * * * *